United States Patent [19]

Une

[11] Patent Number: 4,838,719

[45] Date of Patent: Jun. 13, 1989

[54] SHEET TENSIONING PRINTER ROLLERS

[75] Inventor: Ryuzo Une, Fukuyama, Japan

[73] Assignee: Mitsubishi Denki Kabushiki Kaisha, Tokyo, Japan

[21] Appl. No.: 59,364

[22] Filed: Jun. 8, 1987

[30] Foreign Application Priority Data

Sep. 29, 1986 [JP] Japan ..... 61-228347

[51] Int. Cl.[4] ..... B41J 11/24; B41J 15/16

[52] U.S. Cl. ..... 400/618; 400/551

[58] Field of Search ..... 400/618, 551, 565

[56] References Cited

U.S. PATENT DOCUMENTS

| | | | |
|---|---|---|---|
| 4,034,842 | 7/1977 | Giacone | 400/317.1 |
| 4,043,440 | 8/1977 | Busch | 400/618 |
| 4,360,279 | 11/1982 | Sugihra | 400/618 |
| 4,505,603 | 3/1986 | Yana | 400/120 |
| 4,642,659 | 2/1987 | Nagashima et al. | 400/618 |

FOREIGN PATENT DOCUMENTS

| | | | |
|---|---|---|---|
| 49290 | 5/1981 | Japan | 400/618 |
| 118883 | 9/1981 | Japan | 400/618 |
| 39980 | 3/1982 | Japan | 400/618 |
| 116563 | 6/1986 | Japan | 400/551 |
| 116568 | 6/1986 | Japan | 400/618 |

OTHER PUBLICATIONS

Fitzgibbons et al., "Paper Take-Up . . . Feature", IBM Technical Disclosure Bulletin, vol. 23, No. 5, pp. 2159–2160, 10–80.

Momot et al., "Bidirectional . . . Feeding System", IBM Technical Disclosure Bulletin, vol. 27, No. 4B, pp. 2511–2512, 9–84.

*Primary Examiner*—William Pieprz

*Attorney, Agent, or Firm*—Sughrue, Mion, Zinn, Macpeak and Seas

[57] ABSTRACT

A thermal color printer includes a reversible platen roller 9 and associated pinch rollers 11, 10 on the paper feed and discharge sides. The paper is repeatedly advanced back and forth through the printing station to successively print the different color separations. The discharge side pinch roller 10 is coupled to the platen roller by "unequal" spur gear 31, 32 and one-way clutches 33 such that it is frictionally driven by the platen roller in the sheet advance direction and gear driven by and at a slower speed than the platen roller in the reverse or sheet return direction. This serves to tension the sheet of paper during each return conveyance to thus maintain it in tight contact and registration with the platen roller, thereby avoiding offsets between the successive color separation printings and attendant fringe patterns.

3 Claims, 3 Drawing Sheets

SHEET TENSIONING PRINTER ROLLERS

BACKGROUND OF THE INVENTION

1. Field of the invention

This invention relates to a paper feeding device for use in a printer.

2. Description of the prior art

Japanese Kokai No. 60-72773 discloses a thermal color printer in which an image is formed on a recording paper using a multi-colored thermal transfer ribbon by heat generated by a thermal head. The recording paper is repeatedly fed through a transfer or printing station by the forward and reverse rotation of a platen roller with the ribbon being advanced to present its different colors, thus performing multi-color printing.

A cross-sectional view of this prior art printer is shown in FIG. 1, wherein paper 3 is stacked in a cassette 2 which is removably mounted on a body 1 and is fed sheet by sheet by a feed roller 4. A thermal transfer ribbon 7 is wound on a supply reel 5 and a take up reel 6. A thermal head 8 is disposed facing a platen roller 9 and is moved up and down by an electromagnet 12. A pinch roller 11 on the paper feed side and a pinch roller 10 on the paper discharge side are pressed against the platen roller by springs (not shown). The pinch rollers are frictionally driven by the rotation of the platen roller. A friction member 13 and a brake 14 are provided above the pinch roller 11 on the feed side, together with aligning rollers 15, 16. Paper discharge guides 24, 25 are disposed between the pinch roller 10 on the discharge side and a pair of paper discharge rollers 17, 18, and a paper front or leading edge detector/sensor 19 is disposed at the lower end of the discharge guides. Paper guides 20, 21, 22 are provided above the pair of aligning rollers 15, 16 to guide the sheets of paper from the cassette 2 and from a manual feed tray 25. The printer body includes a stacker 26, a power source 27 and a control panel 28.

In operation, a sheet of paper taken out of the cassette 2 by the rotation of the feed roller 4 passes between the paper guides 20, 21, and is fed by the aligning rollers 15, 16 into the nip between the platen roller 9 and the pinch roller 11 on the paper feed side. The paper is then advanced between the platen roller and the transfer ribbon 7 and through the nip at the pinch roller 10 on the discharge side until its leading edge reaches the sensor 19. At this point appropriate electrical signals are applied to the thermal head 8, and the printing is started for a first color. The printed paper advances through the discharge guides 24, 25 and between the rollers 17, 18 until its trailing edge arrives at the nip between the platen roller 9 and the pinch roller 11 on the feed side. The paper is then returned by the reverse rotation of the platen roller until its leading edge arrives at the sensor 19. The same printing operation is then repeated for each color on the ribbon 7, and the sheet(s) is finally discharged to the stacker 26.

With such a prior art thermal printer the paper sometimes becomes loosened and disengaged from the surface of the platen roller due to its repeated conveyance in the forward and reverse directions, and the pure "idling" operation of the pinch rollers 10, 11. This results in misalignments or offsets between the different color prints or separations, and produces undesirable fringe patterns.

SUMMARY OF THE INVENTION

The present invention solves the above-discussed problem of the prior art printer by providing a method and apparatus for tensioning the paper before the printing of the first color and thereafter during each reverse or return run preceding subsequent color printings, thereby maintaining the paper in close contact with the platen roller at all times and avoiding any offsets or dislocations in the color separations.

This is accomplished by coupling the discharge side pinch roller to the platen roller through "unequal" gears and one-way clutches such that the pinch roller is frictionally driven by and at the same peripheral speed as the platen roller in the advance or forward direction with the clutches disengaged, but is driven by the gears in the reverse direction at a slower speed than the platen roller to thus tension the trailing or following run of the paper web.

DETAILED DESCRIPTION OF THE PREFERRED EMBODIMENT

An embodiment according to the present invention is described hereunder referring to FIGS. 2 through 5.

Figure 1:
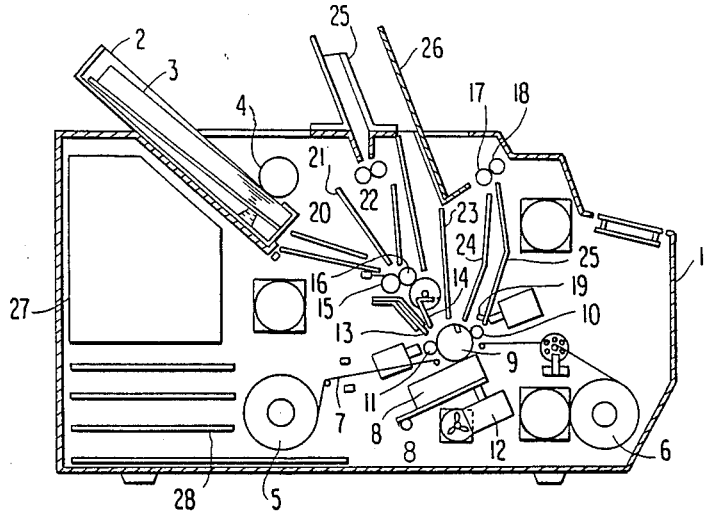
FIG. 1 PRIOR ART
FIG. 1 is a sectional side view of a printer according to the prior art.
Figure 2:
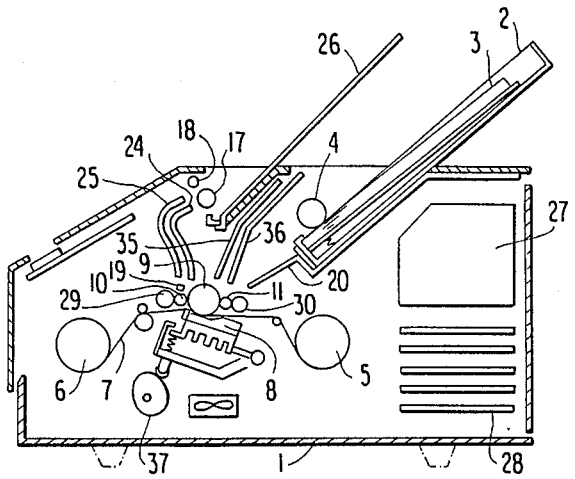
FIG. 2 is a sectional side view of a printer according to the present invention.
Figure 3:
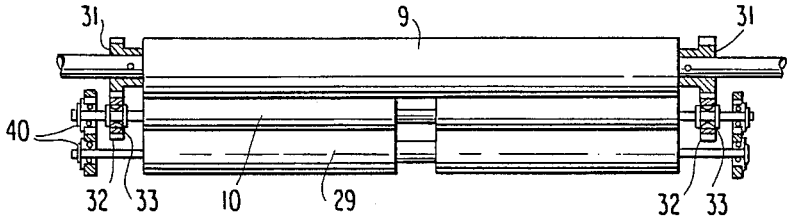
FIG. 3 is a plan view showing the coupling of the platen and pinch rollers according to the invention.

A pinch roller 11 on the paper feed side and a pinch roller 10 on the paper discharge side are pressed against a platen roller 9, and their ends are rotatably supported by bearings 40 (FIG. 3). Spur gears 31 are provided at opposite ends of the platen roller 9, and are engaged with spur gears 32 provided at the ends of the pinch roller 10 on the discharge side. The spur gears 32 mounted on the pinch roller 10 include one-way clutches 33 such that the peripheral speed of the pinch roller 10 coincides with that of the platen roller 9 when the platen roller rotates in a normal or sheet advance direction, but a relative "slippage" corresponding to the spur gear ratio is induced between the platen roller and the pinch roller 10 when the platen roller is rotated in a reverse direction. The pinch roller 10 is thus frictionally driven by the platen roller in the sheet advance direction, and gear driven by the platen roller at a slower peripheral speed in the reverse or return direction. Such speed difference is due to the spur gears being "unequal", i.e. the ratio of their teeth being unequal to the ratio of the roller circumferences, or the ratio of their diameters being unequal to the ratio of the roller diameters. Backup rollers 29, 30 are respectively engaged with the pinch rollers 10, 11, and their ends are rotatably supported by bearings 40 in the same manner as the pinch rollers. A disengaging lever 34 for the thermal transfer ribbon 7 is provided on the front end of the thermal head 8, and is moved up and down by the rotation of a cam 37 disposed beneath the head. Reference numerals 35, 36 and 38 denote paper guides. The remaining parts are designated with the same reference numerals shown in FIG. 1.

Figure 6:
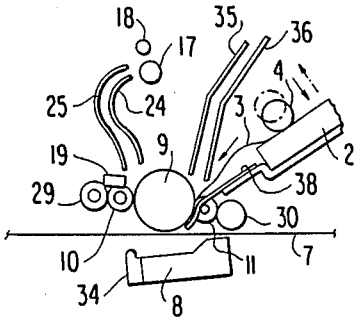
FIG. 6 through FIG. 12 are sequential end views of the roller and printing zone for explaining the operation of the invention.
Figure 7:
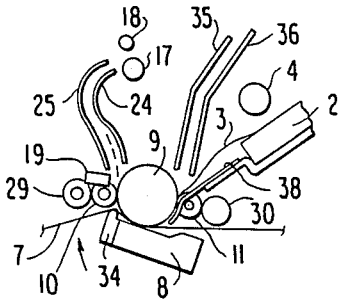

In operation, a sheet of paper 3 is drawn out of the cassette 2 by the feed roller 4 and sent to the platen roller 9 along the paper guide 38 with the thermal head 8 lowered as shown in FIG. 6. The platen roller is then rotated in the forward or advance direction, i.e., in the direction of arrow A in FIG. 4, with the thermal head raised as shown in FIG. 7. The pinch rollers 11, 10 on the feed side and the discharge side are both frictionally rotated at the same peripheral speed as the platen roller with the clutches 33 disengaged or idling. The paper thus passes through the nip between the platen roller 9 and the pinch roller 11, and is thereafter guided by the raised head and heat transfer ribbon into the nip between the platen roller and the pinch roller 10. When the leading edge of the sheet 3 reaches the sensor 19, the rotation of the platen roller 9 is temporarily halted, the thermal head 8 is lowered, and the platen roller than resumes its rotation to advance the sheet to the position shown by the chain line in FIG. 7.

Figure 4:
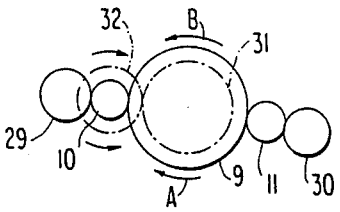
FIG. 4 and FIG. 5 are explanatory end views of the rollers.
Figure 5:
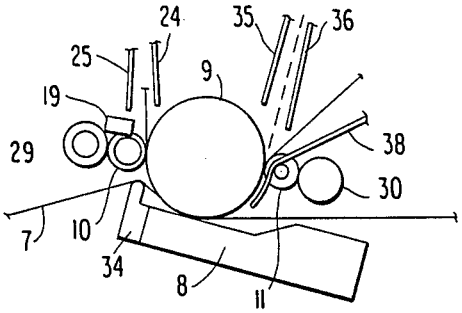
Figure 8:
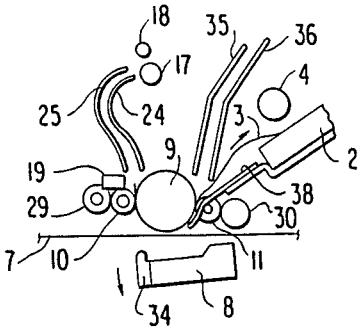
Figure 9:
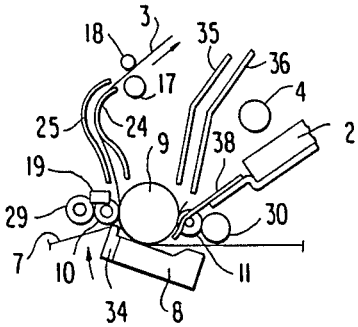
Figure 10:
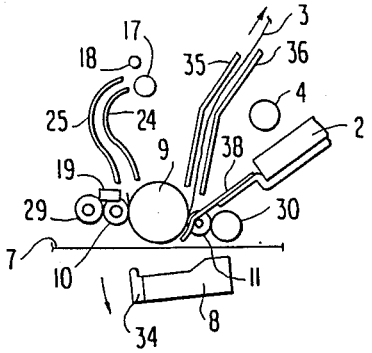
Figure 11:
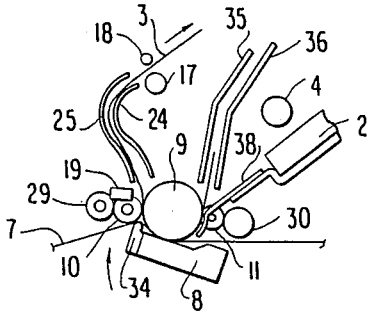
Figure 12:
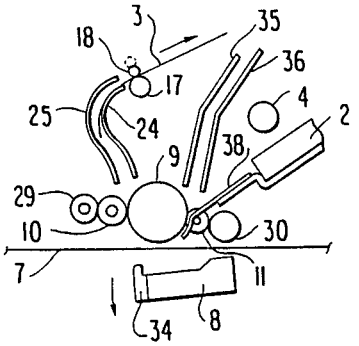

The platen roller is then rotated in a reverse or return direction, i.e., in the direction of arrow B in FIG. 4, which drives the sheet of paper back until it reaches a position whereat its leading edge arrives at the sensor 19 as shown in FIG. 8. During such return conveyance the clutches 33 are engaged and the pinch roller 10 is rotated at a speed slower than the peripheral speed of the platen roller 9 by the spur gears 31, 32. As a result the paper is braked or tensioned by the pinch roller 10, which "pulls" it into close and intimate contact with the outer peripheral surface of the platen roller. The platen roller 9 and the pinch rollers 10, 11 are then rotated in the advance direction with the thermal head 8 raised again as shown in FIG. 9, and printing is commenced by the application of appropriate electrical signals to the head. The sheet being printed with one color advances through discharge guides 24, 25 until it reaches a position whereat its trailing edge, as detected by a further sensor (not shown), arrives at the nip between the platen roller and the pinch roller 11. The platen roller 9 is then rotated in the reverse direction with the thermal head 8 lowered as shown in FIG. 10, and the sheet of paper passes up between guides 35, 36 until its leading edge is returned to the position of the sensor 19. During such return the paper is tensioned in the same manner described above by the gear driven pinch roller 10, and is thus maintained in intimate registration and contact with the peripheral surface of the platen roller 9. The printing of the other colors is performed by repeating the operations shown in FIG. 9 and FIG. 10, with the controlled advance of the ribbon 7 to present its successive colors. After the completion of the printing as shown in FIG. 11, the sheet of paper is discharged to the stacker 26 as shown in FIG. 12.

Although the invention has been described in connection with the pinch roller on the discharge side tensioning the paper during each reverse conveyance, the same effect and advantages can be realized by gearing the feed side pinch roller 11 to the platen roller via a one-way clutch and tensioning the paper during each forward conveyance.

What is claimed is:

1. A thermal transfer color printer, comprising:

(a) a platen roller (9) mounted for forward and reverse rotation to advance a sheet of paper through a printing station in a first, print direction of conveyance and return said sheet of paper back through the printing station in a second, opposite direction of conveyance pursuant to the successive printing of different, overlying color separations on the paper, (b) first and second pinch rollers (11, 10) individually disposed parallel to the platen roller, on opposite, feed and discharge sides of the printing station, and in biased engagement with the platen roller to define respective sheet conveying nips therewith, said first and only said first pinch roller being exclusively frictionally driven by the platen roller at a same peripheral speed as the platen roller in both directions of conveyance, (c) drive means (33) for enabling the frictional driving of said second pinch roller by and at said same peripheral speed as the platen roller when conveying said sheet of paper in said first direction, (d) reduction gears (31, 32) for positively driving said second pinch roller at a slower peripheral speed than that of the platen roller when conveying said sheet of paper in said second direction such that said sheet of paper is tensioned and maintained in intimate contact with the platen roller to avoid mis-registrations between the color separations and attendant fringe patterns, (e) a thermal print head (8) disposed at the printing station, and (f) means (37) for:

(1) urging the print head against the platen roller during the conveyance of the sheet of paper in the first direction to thereby tension said sheet, and (2) retracting the print head away from the platen roller during the conveyance of the sheet in the second direction whereat the sheet is exclusively tensioned by the reduction gears.

2. A printer according to claim 1, wherein said reduction gears comprises unequal gears (31, 32) interconnecting shafts of the platen roller and said second pinch roller, and said drive means comprises a one-way clutch (33) coupled between one of said gears and an associated roller shaft.

3. A method of avoiding mis-registrations between successive color separation printings on a sheet of paper in a printer including a platen roller (9) disposed at a printing station, a print head (8) disposed at the printing station for cooperation with the platen roller, and first and second pinch rollers (11, 10) individually disposed parallel to the platen roller on opposite, feed and discharge sides thereof and in biased engagement therewith to define respective first and second sheet conveying nips, said method comprising the steps of:

(a) rotating the platen roller in a first, advance direction to feed a sheet of paper between the first and second nips in succession and through the printing station to a predetermined distance with the first and second pinch rollers being frictionally driven by the platen roller, (b) simultaneously with step a), urging the print head against the platen roller to thereby tension the sheet of paper, (c) rotating the platen roller in a second, reverse direction to return the sheet of paper back through the printing station until a leading edge thereof is proximate an exit from the second nip while:

(1) frictionally driving only the first pinch roller from the platen roller, (2) retracting the print head away from the platen roller, and (3) positively driving the second pinch roller via reduction gears at a slower peripheral speed than that of the platen roller to tension a following portion of the paper and maintain it in intimate contact with the platen roller, and (d) repeating steps (a), (b) and (c) until each color separation has been printed.

* * * * *